US005950834A

United States Patent [19]

Woodnorth et al.

[11] Patent Number: 5,950,834

[45] **Date of Patent: *Sep. 14, 1999**

[54] LUNCH HOLDER FOR HOLDING A FOOD PRODUCT AND A BEVERAGE CONTAINER

[76] Inventors: Brian E. Woodnorth, 4041 Dupont Ave. South, Minneapolis, Minn. 55409; Monte L. Levin, 300 E. 56th St., New York, N.Y. 10022

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,861

[22] Filed: Aug. 26, 1997

[51] Int. Cl.[6] ..... B65D 1/24

[52] U.S. Cl. ..... 206/541; 220/523

[58] Field of Search ..... 206/223, 541, 206/542, 543, 546, 547; 220/500, 503, 521, 522, 523, 524, 525, 553

[56] References Cited

U.S. PATENT DOCUMENTS

| | | |
|---|---|---|
| 33,946 | 12/1861 | Irwin . |
| 324,443 | 8/1885 | Wilson . |
| 1,661,728 | 3/1928 | La Rue . |
| 1,933,894 | 11/1933 | Clink . |
| 1,944,502 | 1/1934 | Factor . |
| 2,339,580 | 1/1944 | Park . |
| 2,457,043 | 12/1948 | Histand . |
| 2,731,996 | 1/1956 | Hayes . |
| 3,082,903 | 3/1963 | Stevens et al. . |
| 3,372,690 | 3/1968 | Ruiz . |
| 3,580,650 | 5/1971 | Morris . |
| 3,633,785 | 1/1972 | Cyr et al. . |
| 3,823,817 | 7/1974 | Hughes . |
| 3,933,296 | 1/1976 | Ruskin et al. . |
| 3,999,661 | 12/1976 | Jones . |
| 4,132,344 | 1/1979 | Jewell . |
| 4,412,616 | 11/1983 | Williams . |
| 4,535,889 | 8/1985 | Terauds . |
| 4,653,685 | 3/1987 | Leary et al. . |
| 4,915,251 | 4/1990 | Payne . |
| 4,934,549 | 6/1990 | Allen . |
| 4,951,866 | 8/1990 | Rusnak . |
| 5,012,971 | 5/1991 | Cozzi et al. . |
| 5,027,972 | 7/1991 | Bartholomew . |
| 5,046,659 | 9/1991 | Warburton . |
| 5,277,329 | 1/1994 | Pomroy et al. . |
| 5,323,926 | 6/1994 | Pomroy et al. . |

FOREIGN PATENT DOCUMENTS

| | | |
|---|---|---|
| 0 337 960 | 10/1989 | European Pat. Off. . |
| 0 420 429 | 4/1991 | European Pat. Off. . |
| 1 225 103 | 9/1966 | Germany . |

*Primary Examiner*—Jacob K. Ackun
*Attorney, Agent, or Firm*—Rockey, Milnamow & Katz

[57] ABSTRACT

A lunch holder for holding a food product and a beverage container includes a cover section and a base section. A base divider separates the base section into a food product compartment and a beverage container compartment including a container receiving area shaped to receive a generally cylindrical container. The beverage container compartment further includes a recessed portion disposed below the container receiving area for collecting condensation falling from the cylindrical beverage container and which is further shaped to receive a rectangular beverage container. The lunch holder also includes an inner lid which covers the food product compartment.

6 Claims, 4 Drawing Sheets

LUNCH HOLDER FOR HOLDING A FOOD PRODUCT AND A BEVERAGE CONTAINER

FIELD OF THE INVENTION

The present invention relates generally to food holders, and more particularly to a lunch holder for holding a food product and a beverage container.

BACKGROUND OF THE INVENTION

A variety of food holders are known for packing and carrying lunches. Such holders include disposable carriers, such as paper bags, plastic bags and cardboard containers, and more permanent carriers, such as containers fabricated of metal and/or semi-rigid plastic. When using such holders to pack a typical lunch, each food product (e.g., sandwich, salad, chips, cookies and fruit) often is individually wrapped, for instance, in paper, foil or cellophane, or is placed into individual containers, such as flexible plastic bags or sealable semi-rigid plastic containers. After use, such individual wrappers or containers are either thrown away or must be cleaned for subsequent re-use.

Oftentimes, it is desirable to pack a beverage container, such as a soda can, plastic bottle or juice box, with the food products. With the lunch holders described above, packing a beverage container can present several problems. For example, if the food products are placed in a wrapper or flexible container, the beverage container may shift during carrying or storage and break, smash or bruise the food products. Or, if the beverage container has been refrigerated or frozen, condensation from the container may result in soggy, inedible food products.

Accordingly, it would be desirable to provide an improved lunch holder for packing both food products and a beverage container. Such a lunch holder would eliminate the need to pack individual food products into separate containers that would fit into the lunch holder and that then must either be disposed or washed after use. Further, the lunch holder would isolate a beverage container from the food products, thus protecting the food products from damage, such as from smashing, bruising or moisture.

SUMMARY OF THE INVENTION

The present invention provides a lunch holder for carrying a food product and a beverage container. The food product or products may be placed directly in the lunch holder without the need for extra packaging materials. Further, the lunch holder is designed to isolate the beverage container from the food products.

A first embodiment of the invention provides a lunch holder for holding and carrying a food product and a beverage container. The lunch holder comprises a base section connected to a cover section such that the cover section is movable between open and closed positions relative to the base section. A compartment divider separates the base section into a food product compartment and a beverage container compartment. The beverage container compartment includes a container receiving area that is shaped to at least partially receive the beverage container. The lunch holder further includes an inner lid that is movable between an open lid position and a closed lid position covering the food product compartment. When in the closed lid position, the inner lid rests over an upper edge of the compartment divider.

According to a further aspect of the invention, the container receiving area is further shaped to receive a generally cylindrical beverage container and is defined in part by an arcuate wall portion.

In another aspect of the invention, the beverage container compartment further includes a recessed portion disposed below the container receiving area to collect condensation from the beverage container when the beverage container is resting in the container receiving area. The recessed portion may be further shaped to receive a generally rectangular beverage container.

According to yet another aspect of the invention, the lunch holder includes a cover divider that separates the cover section into a plurality of cover regions. The cover divider retains the inner lid in the closed lid position when the cover section is in the closed position.

These and other advantages of the present invention will become apparent from the detailed description given hereinafter. It should be understood, however, that the detailed description and specific embodiments are offered for illustrative purposes only. Based on the following description, various changes and modifications within the spirit and scope of the invention will become readily apparent to one of ordinary skill in the art.

BRIEF DESCRIPTION OF THE DRAWINGS

The preferred exemplary embodiment of the invention will hereinafter be described in conjunction with the appended FIGURES, in which like reference numerals denote like elements, and.

DETAILED DESCRIPTION OF A PREFERRED EMBODIMENT

Figure 1:
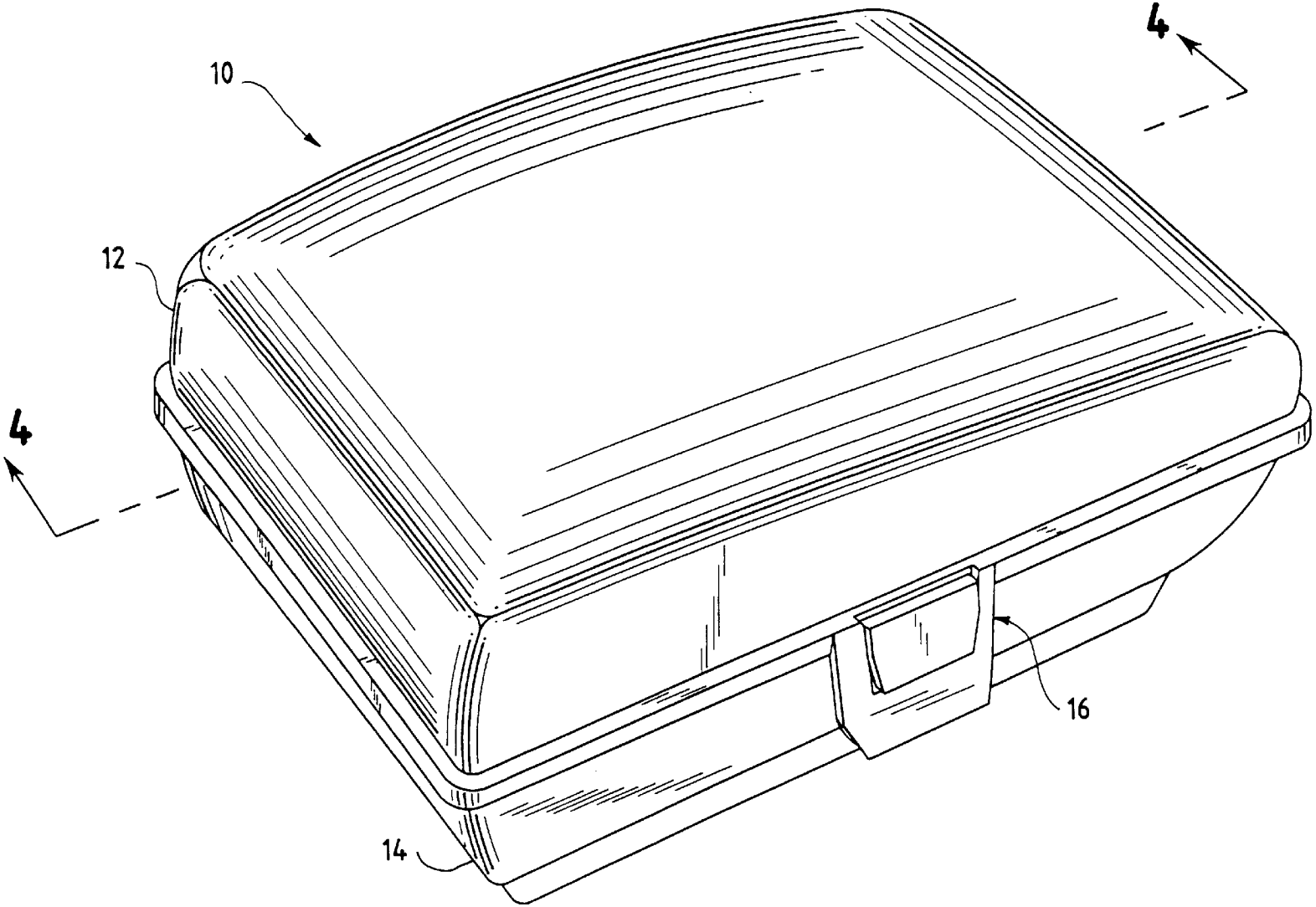
FIG. 1 is a perspective view of an exemplary lunch holder according to a preferred embodiment of the invention, in which the lunch holder is shown in a closed position.
Figure 2:
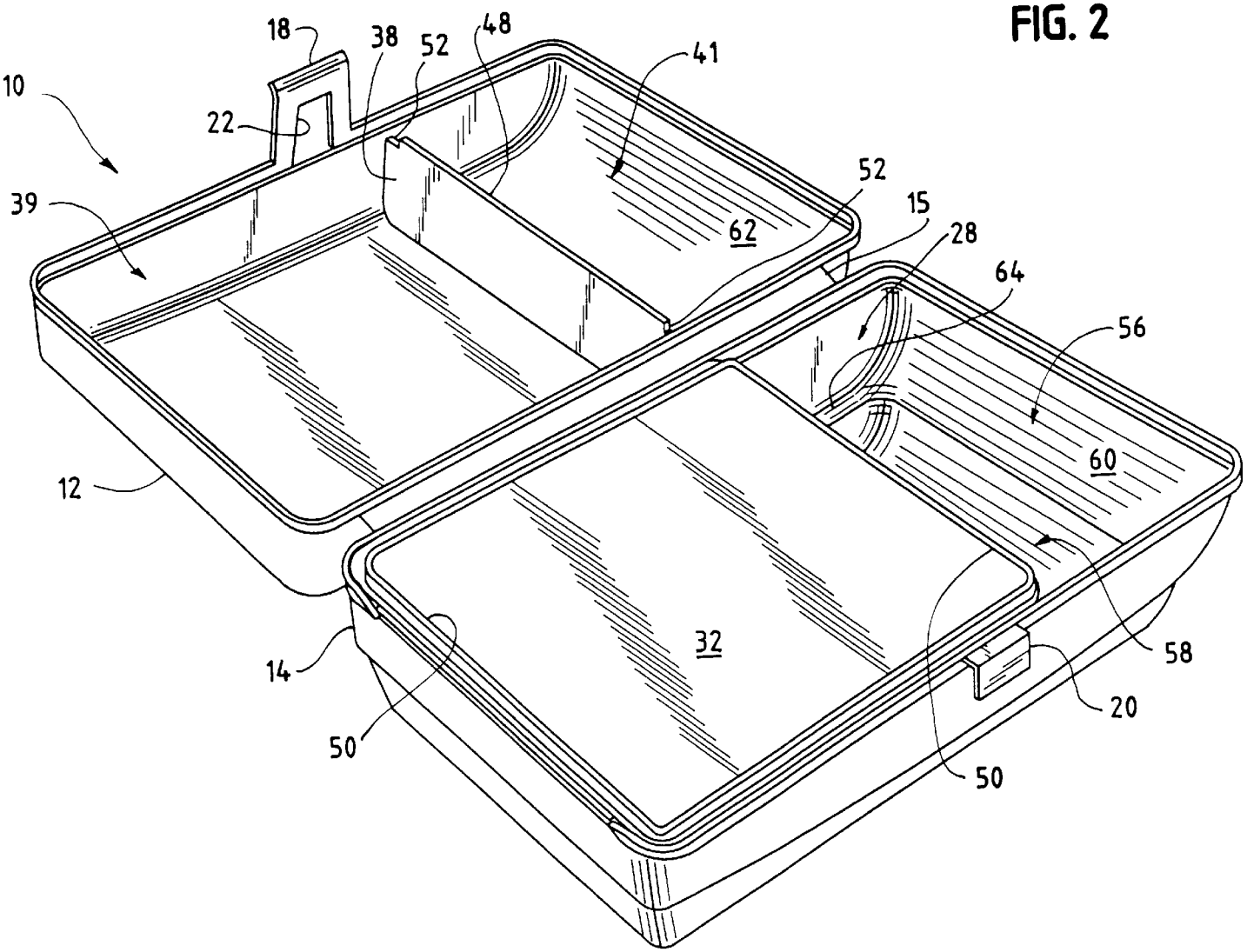
FIG. 2 is a perspective view of the lunch holder of FIG. 1, in which the lunch holder is illustrated in an open position, revealing a beverage container compartment and a food product compartment which is covered by an inner lid.

Referring generally to FIGS. 1 and 2, a lunch holder 10 is illustrated in a closed position (FIG. 1) and an open position (FIG. 2). Lunch holder 10 includes a cover section 12 and a base section 14. Cover section 12 and base section 14 may be connected along a side wall of each section, such as by a living hinge 15. In the open position, cover section 12 and base section 14 rest in a side-by-side relationship as illustrated in FIG. 2. In the closed position shown in FIG. 1, cover section 12 is superposed above base section 14.

Holder 10 further may include a clasp 16 (FIG. 1) for retaining holder 10 in the closed position. Clasp 16 preferably includes a tab member 18 (FIG. 2) connected to or integrally formed with cover section 12 and a catch member 20 (FIG. 2) connected to or integrally formed with base section 14. Tab member 18 includes an aperture 22 sized to receive and retain catch member 20. In other embodiments, alternative retaining or locking arrangements may be used in place of clasp 16.

Figure 3:
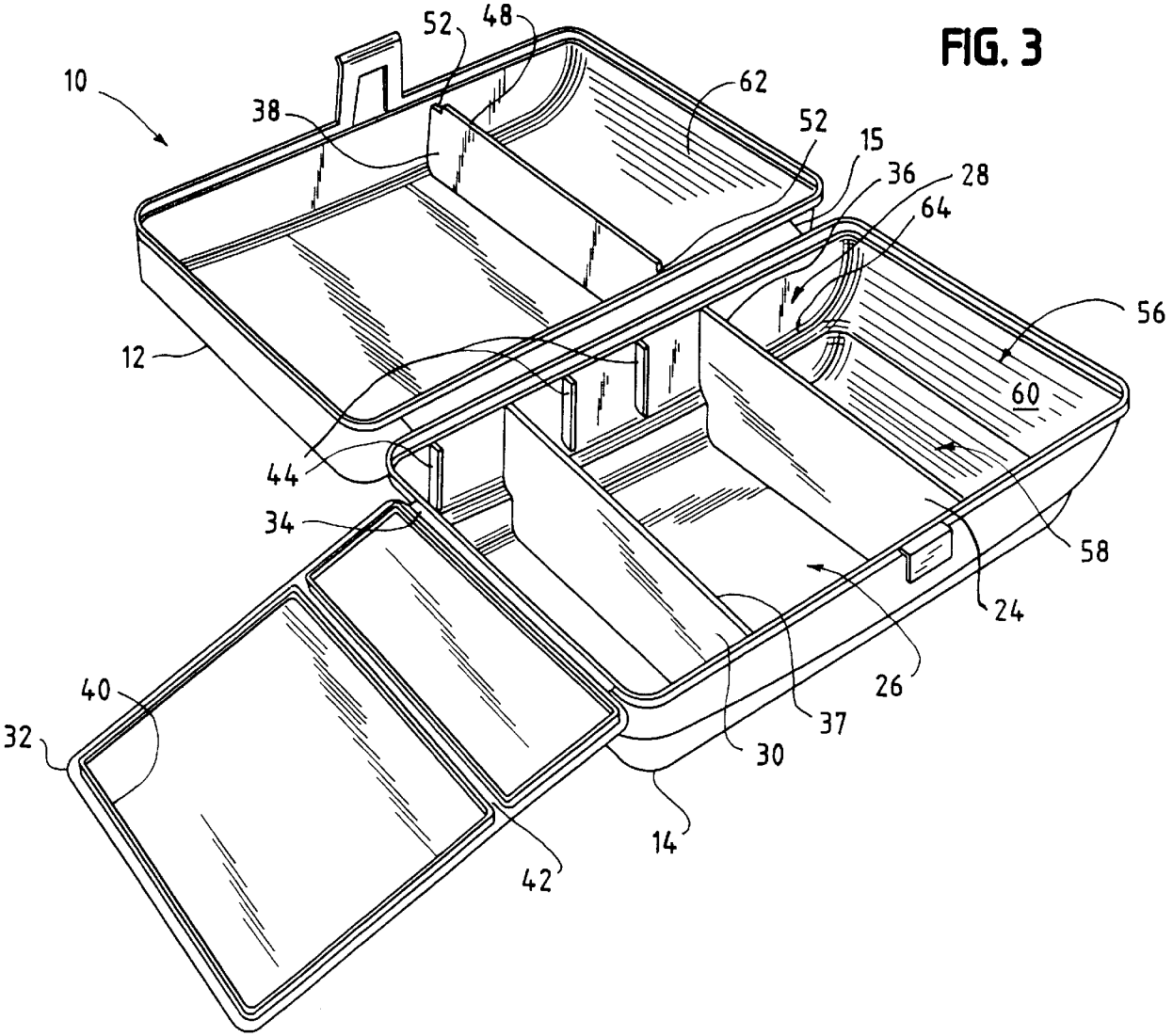
FIG. 3 is a perspective view of the open lunch holder of FIG. 2, in which the inner lid is in an open lid position, revealing the interior of the food product compartment.

Referring to FIG. 3, holder 10 further includes a divider 24 which separates base section 14 into a food product compartment 26 and a beverage container compartment 28. In the preferred embodiment, base section 14 includes a second divider 30 which divides food product compartment 26 into a plurality of subcompartments. In the preferred embodiment illustrated in FIG. 3, divider 30 is configured as a single upwardly extending wall which is substantially parallel to divider 24. However, divider 30 may also take on other configurations, such as a T-shape, or may be positioned perpendicular to or at an at an angle with respect to divider 24. Alternatively, base section 14 may include a plurality of dividers 30. In any event, divider 30 allows an individual to maintain a combination of food products, such as chips and cookies or salad and a dressing package, in isolated areas within food product compartment 26. Further, food product compartment 26 shapes and sizes and its various subcompartments maybe sized to receive a variety of food containers.

Food products are retained within food product compartment 26 by an inner lid 32 and are isolated from the beverage container compartment 28 by divider 24. Food product compartment 26 is defined in part by a plurality of upwardly extending inner wall surfaces which may be, for instance, the inner surfaces of base section 14 or the inner surfaces of dividers 24 and 30. Inner lid 32 is preferably connected to base section 14 along an upper edge of one of its side walls, such as by a living hinge 34. However, other types of connections can be used which may be disposed along other side walls of base section 14, or lid 32 may be connected to base section 14 along an upper edge 36 of divider 24. As yet another alternative, lid 32 may be connected to cover section 12 such as along an upper edge of one side wall. Regardless of the manner of connection, lid 32 is designed to be movable between an open lid position (see FIG. 3) and a closed lid position (see FIG. 2) in which lid 32 covers food product compartment 26 and rests over upper edge 36 of divider 24. In the closed position, inner lid 32 assists in retaining the freshness of food products stored within food product compartment 26.

Figure 4:
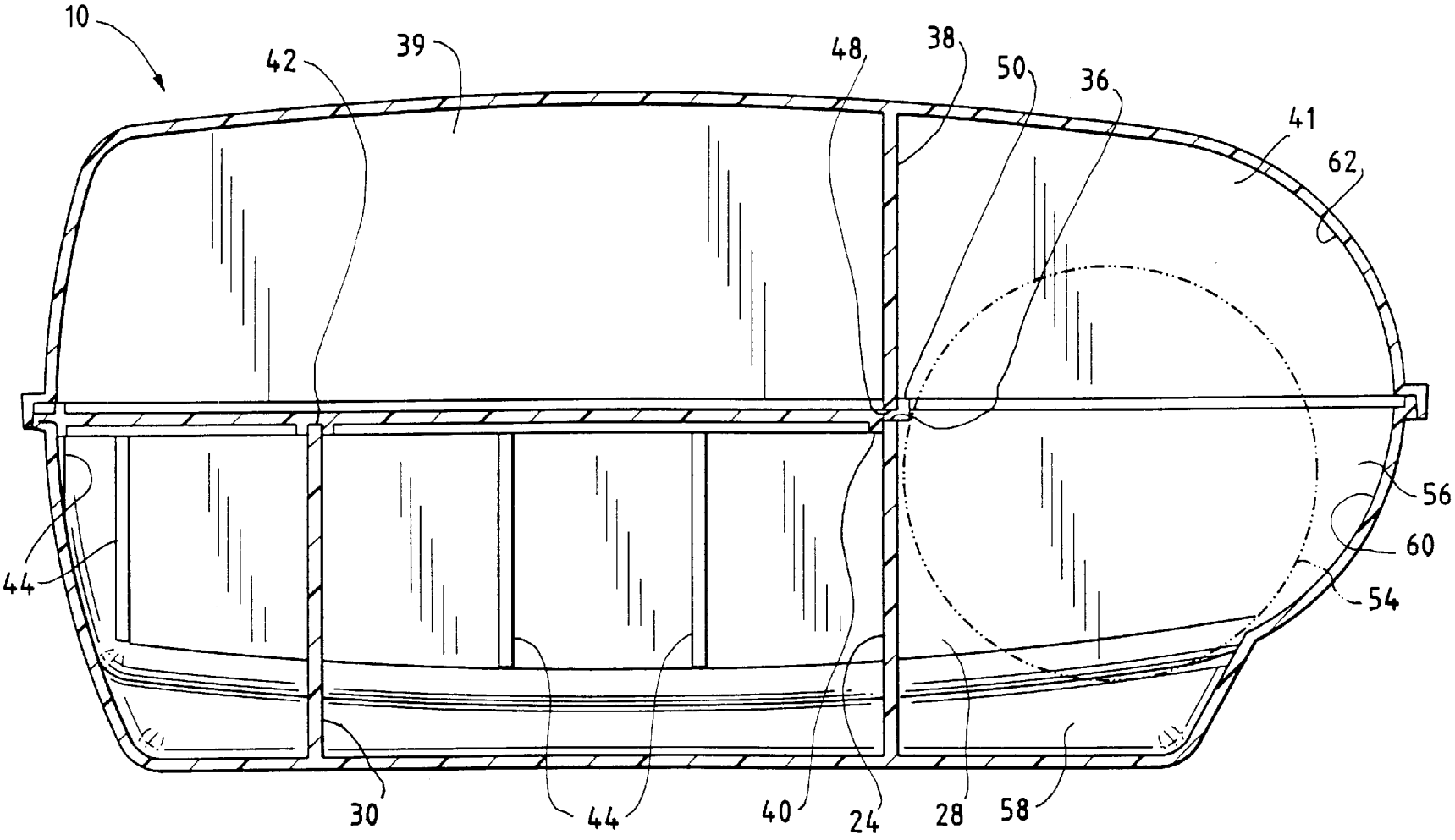
FIG. 4 is a cross-sectional view of the lunch holder of FIG. 1 taken generally along the line 4—4, showing the position of a generally cylindrical beverage container resting within the beverage container compartment.

In addition to upper edge 36, lunch holder 10 may include a variety of other features which assist in supporting and/or retaining inner lid 32 in the closed lid position. For example, lid 32 may include a flange 40 disposed on the under side of lid 32 which engages at least divider 24. In the embodiment illustrated in the FIGURES, flange 40 abuts against the inner surface of divider 24, thus retaining lid 32 in the closed lid position by frictional engagement between flange 40 and divider 24. Alternatively, flange 40 may comprise a pair of spaced apart depending flanges (not shown) defining a channel in which upper edge 36 of divider 24 is received. As yet another alternative, and as illustrated in the FIGURES, flange 40 may extend around the periphery of the under side of lid 32 such that flange 40 may also frictionally engage a portion of the other inner wall surfaces which define food product compartment 26. Flange 40 may also be configured to engage divider 30. For example, as best illustrated in FIGS. 3 and 4, flange 40 may define a channel 42 for receiving an upper edge 37 of divider 30.

Base section 14 may also include a plurality of support members 44 which assist in properly positioning inner lid 32 when in its closed lid position. In the preferred embodiment illustrated in FIGS. 3 and 4, support members 44 comprise vertical ribs which are interspersed along at least some of the inner wall surfaces of food product compartment 26. Although support members 44 preferably abut against the under surface of inner lid 32 when in its closed position, an abutting relationship is not necessary. Rather, support members 44 primarily assist in preventing portions of inner lid 32 from bowing, such as when a weighty food product is placed on the upper surface of lid 32. Further, support members 44 prevent lid 32 from falling into food product compartment 26 if, for instance, the inner wall surfaces of compartment 26 become warped or bowed in an outward direction.

Lid 32 also is preferably retained in the closed lid position by a cover divider 38 which separates cover section 12 into a plurality of cover regions, such as regions 39 and 41. When cover section 12 is in the closed position relative to base section 14, cover divider 38 assists in retaining inner lid 32 in the closed lid position, preferably by abutting against the upper surface of lid 32, which further substantially seals beverage container compartment 28 from cover region 39. The sealing arrangement is preferable because it prevents moisture which may collect in beverage container compartment 28, such as from condensation from a beverage container, from entering cover region 39 and damaging any food products (e.g., a sandwich) that may be placed therein. Alternatively, cover divider 38 may be positioned such that its upper edge 48 is in close proximity to the upper surface of lid 32, thus preventing lid 32 from lifting from its closed lid position.

The sealing arrangement between cover divider 38 and inner lid 32 may be further improved by a flange 50. For example, as best illustrated in FIGS. 3 and 4, cover divider 38 may be arranged such that it abuts against, or is in close proximity to, flange 50, which preferably extends around the periphery of the upper surface of inner lid 32. Accordingly, even if upper edge 48 of divider 38 does not touch the upper surface of lid 32, flange 40 may assist in preventing moisture from entering cover region 39. Additionally, the mating relationship between flange 50 and cover divider 38 provides a stop which prevents lid 32 from moving from its resting position over base divider 24. Further, in the preferred embodiment illustrated in the FIGURES in which flange 50 extends around the entire periphery of the upper surface of lid 32, cover divider 38 includes cutout regions 52 which are positioned and sized to prevent interference of divider 38 with flange 50. In alternative embodiments, flange 50 may not completely surround the periphery of the upper surface of inner lid 32 but may be disposed only near one edge such that it may mate with cover divider 38 as described above.

Referring now to FIGS. 2–4, beverage container compartment 28 shaped to at least partially receive a beverage container, such as a generally cylindrical container 54 (e.g., a soda can or plastic bottle) or a generally rectangular container (e.g., a juice box) (not shown). In the preferred embodiment, compartment 28 includes a container receiving area 56 and a recessed portion 58 disposed below area 56. Container receiving area 56 is shaped to retain beverage container 54 at least partially suspended above recessed portion 58 and preferably is defined in part by an arcuate wall portion 60. Arcuate wall portion 60 preferably is the inner surface of a side wall of base section 14. Alternatively, base divider 24 may include an arcuate wall portion; or arcuate wall portion 60 may be a sleeve or insert made of a semi-rigid material, such as plastic, which is positioned within container receiving area 56. In any event, arcuate wall portion 60 is shaped to at least partially receive a generally cylindrical beverage container, such as container 54 or a plastic drink bottle, which may have a wide variety of diameters. Further, cover region 41, which is superposed above beverage container compartment 28 when cover section 12 is in the closed position, also may include an arcuate wall portion 62 having a size and shape similar to that of arcuate wall portion 60. In alternative embodiments, container receiving area 56 may be defined by substantially planar wall surfaces. Container receiving area 56 may further include one or more horizontal ledges 64 which may provide additional support for retaining beverage container 54 above recessed portion 58.

Recessed portion 58, which is disposed below container receiving area 56, provides a collection area for condensation which may drip from a beverage container which has been refrigerated or frozen, and which is resting in container receiving area 56. Accordingly, recessed portion 58 may be designed to have a variety of sizes and shapes. In the preferred embodiment, however, recessed portion 58 has a generally rectangular shape and is sized to at least partially receive a rectangular beverage container, such as a conventional juice box.

Lunch holder 10 preferably is made of a semi-rigid plastic material. Further, all the various elements of lunch holder 10, which have been described above, preferably are integrally formed using a conventional molding process. Further, the exterior surfaces of lunch holder 10 may include various surface features, such as texturing, grips or handles, which facilitate grasping or carrying of holder 10.

Although the foregoing description has been provided for the presently preferred embodiment of the invention, the invention is not intended to be limited to any particular arrangement, but is defined by the appended claims. For example, the support members and dividers may be designed in many different configurations. Further, the base and cover sections may be generally rectangular or square in shape or may include rounded portions. Also, lunch holder may have a variety of surface features. These and other alternative configurations of the invention, that may occur to those skilled in the art, are intended to form a part of the invention to the extent such alternatives fall within the scope of the appended claims.

What is claimed is:

1. A lunch holder for holding a food product and a beverage container, the lunch holder comprising:

a base section;

a cover section hingedly connected to the base section, the cover section being superposed over the base section when the cover section is in a closed position;

a cover divider separating the cover section into a cover food product area and a cover beverage container area;

a base divider separating the base section into a base food product area and a base beverage container area, the cover product food area and the base food product area defining a food product region, and the cover beverage container area and the base beverage container area defining a beverage container region that includes a beverage container receiving area defined in part by an arcuate wall portion such that the beverage container receiving area is shaped to receive a generally cylindrical beverage container;

an inner lid movable between an open lid position and a closed lid position covering the base food product area and exclusive of the base beverage container area, the inner lid resting over an upper edge of the base divider when in the closed list position, a flange disposed on an upper surface of the inner lid, the flange being engageable with the cover divider to retain the inner lid in the closed lid position; and the cover divider retaining the inner lid in the closed lid position when the cover section is in the closed position.

2. The lunch holder as recited in claim 1, wherein the beverage container region further includes a recessed portion disposed below the beverage container receiving area to collect condensation falling from the cylindrical container when the cylindrical beverage container is resting in the container receiving area.

3. The lunch holder as recited in claim 2, wherein the recessed portion is shaped to received a generally rectangular beverage container.

4. The lunch holder as recited in claim 3, wherein the food product region is defined in part by a plurality of upwardly extending wall surfaces, and the inner lid further rests over a plurality of spaced apart support members when in the closed lid position, the support members being disposed along at least one of the upwardly extending wall surfaces.

5. The lunch holder as recited in claim 3, further comprising a flange disposed on an under surface of the inner lid, the flange being engageable with the base divider to retain the inner lid in the closed lid position.

6. The lunch holder as recited in claim 5, wherein the recessed portion is shaped to receive a generally rectangular beverage container.

* * * * *